US005134753A

United States Patent [19]

Rekuc

[11] Patent Number: 5,134,753

[45] Date of Patent: Aug. 4, 1992

[54] LUGGAGE CASTER

[75] Inventor: Richard J. Rekuc, Pattenburg, N.J.

[73] Assignee: Firma Sudhaus Schloss- und Beschlagtechnik GmbH & Co., Iserlohn, Fed. Rep. of Germany

[21] Appl. No.: 645,062

[22] Filed: Jan. 18, 1991

[51] Int. Cl.[5] ..... B60B 33/00

[52] U.S. Cl. ..... 16/18 CG

[58] Field of Search ..... 16/18 R, 18 CG, 31

[56] References Cited

U.S. PATENT DOCUMENTS

| | | | |
|---|---|---|---|
| 2,495,599 | 1/1950 | Pinnick | 16/41 |
| 2,830,545 | 4/1958 | Robinson et al. | 16/18 CG |
| 3,184,783 | 5/1965 | Brigham | 16/18 CG |
| 3,345,675 | 10/1967 | Haydock | 16/18 CG |
| 3,858,271 | 1/1975 | Howard et al. | 16/18 CG |

FOREIGN PATENT DOCUMENTS

| | | | |
|---|---|---|---|
| 415552 | 10/1946 | Italy | 16/18 CG |

*Primary Examiner*—Robert L. Spruill
*Assistant Examiner*—Donald M. Gurley
*Attorney, Agent, or Firm*—Herbert Dubno

[57] ABSTRACT

A roller assembly or caster for an article of luggage has a casing or housing set into the bottom wall of the article and a stirrup affixed to an upper wall of that housing in which a roller is rotatable. The roller projects through an opening in a generally spherical convex cover and projects in part beyond this cover so that the cover will limit impact of obstructions against the stirrup and roller and will shield the interior of the housing from the incursion of foreign materials. The convex cover is affixed to the stirrup and, when the latter can swivel, swivels together therewith.

7 Claims, 2 Drawing Sheets

LUGGAGE CASTER

FIELD OF THE INVENTION

My present invention relates to a luggage caster and, more particularly, to a roll device adapted to be mounted on a piece of luggage so that the piece of luggage can be readily moved along the ground or a floor. More particularly, the invention relates to a luggage roller of the type in which the roller or wheel is mounted upon a stirrup or fork within a casing or housing which can be recessed in a wall of a suitcase or other luggage article to support the article upon the floor or ground.

BACKGROUND OF THE INVENTION

It is known to facilitate the movement of luggage along the ground or a floor, to provide the luggage with rollers. In one technique, each roller is rotatable in a fork or stirrup and is mounted within a casing which can be recessed in a wall of the luggage so that only a portion of the roller projects beyond the mouth of the casing. The upper end of the stirrup can be affixed to an upper wall of the casing.

Where the casing or housing is set into the suitcase bottom, only a relatively small portion of the roller may project beneath the bottom of the suitcase and, apart from the stirrup and a portion of the roller within the casing, the casing or housing is empty and accessible from below.

It has been found that this construction allows dirt and other foreign material to accumulate in the free space within the housing and is detrimental to the function and reliability of the roller.

Furthermore when the article of luggage is drawn along the ground or a floor, an obstruction can act upon the roller or stirrup over a substantial portion of the height thereof within the casing so that the roller arrangement is readily damaged.

OBJECTS OF THE INVENTION

It is the principal object of the present invention to provide a roller assembly for luggage which is functionally more reliable than earlier systems, is free from a tendency to accumulate dirt and foreign materials within the housing or casing, and is less susceptible to damage upon contact with obstructions and the like than has been the case heretofore.

Another object of the invention is to provide an improved roller assembly for luggage and the like which is characterized by reduced vibration and chattering in use.

Still another object of this invention is to provide an improved luggage caster which avoids the drawbacks of earlier systems as described above.

SUMMARY OF THE INVENTION

These objects are attained, in accordance with the present invention, by providing the stirrup or fork in which the roller is journaled with an outwardly convex cover or cap rigidly connected to the stirrup and substantially closing the mouth of the casing or housing and defining an outwardly convex lower surface of the assembly, the convex cover or cap being formed with an opening through which a horizontal segment of the roller projects, this segment extending below the convex cover.

With this construction, the region which can suffer impact with an obstruction is reduced substantially only to the aforementioned segment, since the convex cover deflects the obstruction otherwise. Only a limited region of the roller may then come into contact with the obstruction and the stirrup and the cover can contribute to stabilization of the roller assembly against impact with an obstruction so that the damage to the roller assembly previously described can no longer occur.

Another advantage of the present invention is that foreign materials cannot accumulate in the case or housing as readily, since the cover practically closes off any access to the casing or housing space around the roller and the stirrup. The average useful life of a roller assembly according to the invention is thus substantially greater than that of prior roller assemblies in which dirt and other foreign bodies could find ready access to the casing or housing from which the roller projected.

According to a feature of the invention, the convex cover is substantially spherically curved, as a consequence of which the opening in the cover can be provided adjacent the nadir of the surface and the roller need only project to a small extent their beyond.

The opening may, advantageously, extend substantially from the nadir to a point close to an outer periphery of the cover, i.e. a point close to the housing. A generally hemispherical shape for the cover can utilize substantially less material than is the case when the cover extends more fully into the casing.

To the extent that the stirrup is to be itself rotatably mounted on the upper wall of the casing or housing, as is the case in a caster construction when the roller is capable of steering and control movement about an axis perpendicular to the axis of rotation of the roller, the cover is so connected with the stirrup that it can follow the rotation and steering movements of the stirrup about its axis. Thus even for caster arrangements, effective protection for the roller and for the housing compartment in which the roller is received, is provided.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
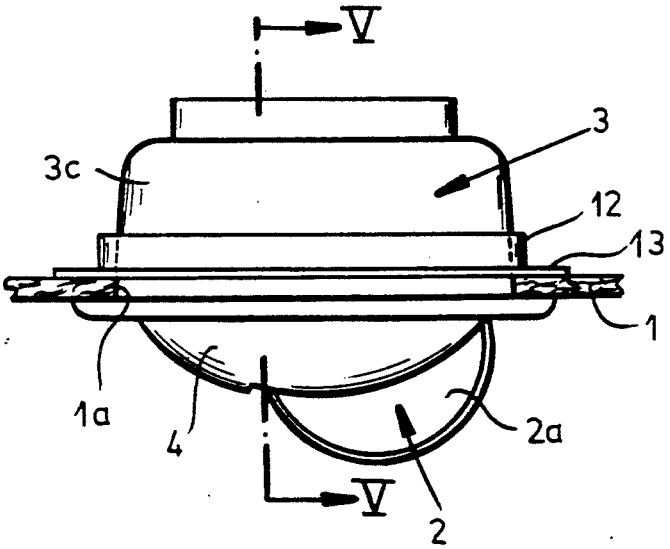
FIG. 2 is a side elevational view of the luggage assembly.
Figure 3:
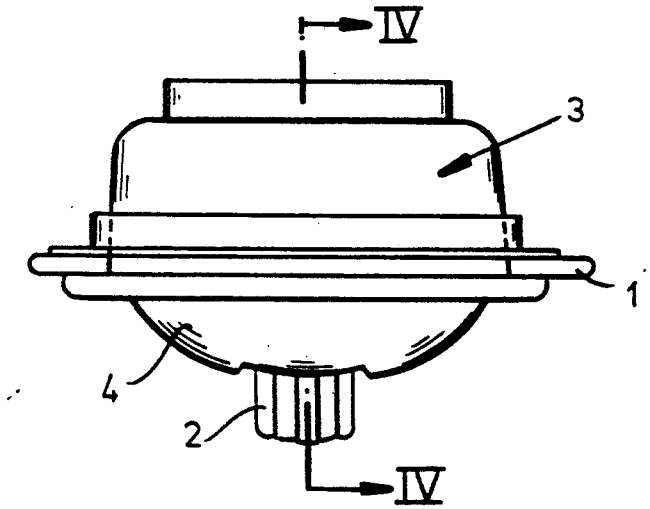
FIG. 3 is a front view thereof.
Figure 5:
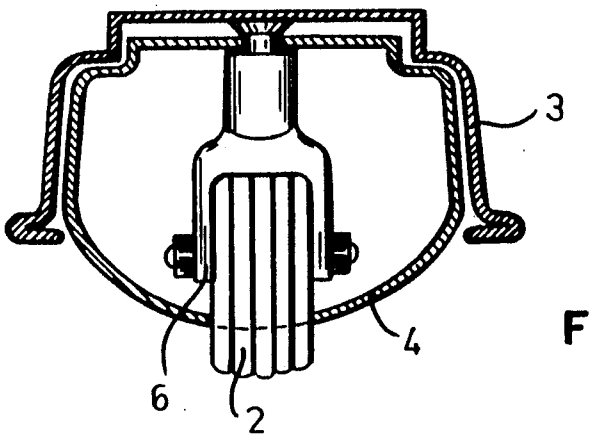
FIG. 5 is a cross sectional view taken along the line V—V of FIG. 2.

A bottom 1 of a suitcase or other article of luggage to be equipped with a roller assembly is formed with an opening 1*a* (FIG. 2) in which a casing or housing 3 is inserted. The casing or housing 3 has a flange 3*a* which is of rectangular configuration and lies along the outer surface of the bottom 1 while a ring 12 has a corresponding rectangular flange 13 located along the inner surface of the bottom to constitute a backing plate for rivets (not shown) traversing holes 3b of the flange 3a, the bottom 1 of the luggage and the flange 13 to secure the housing 3 in the suitcase.

Figure 1:
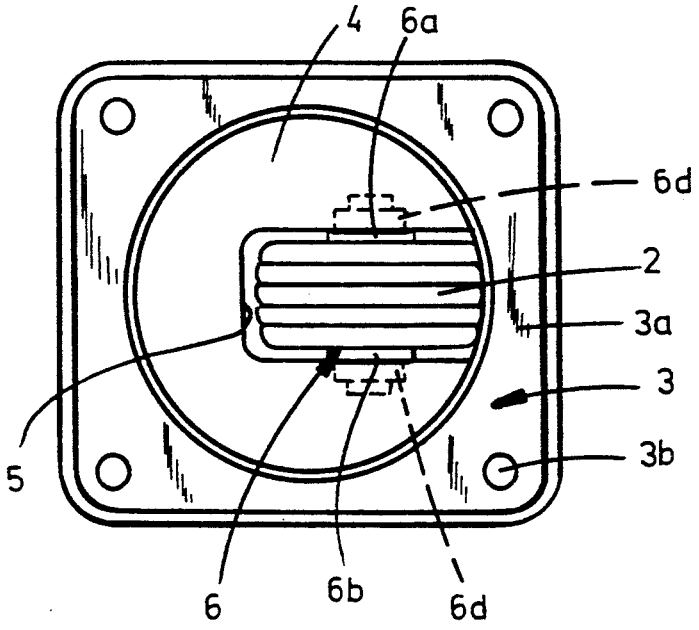
FIG. 1 is a bottom view of a roller assembly for luggage according to the invention.

The housing 3 also has an outwardly concave portion 3c projecting into the interior of the suitcase and forming a cavity 3d which is open outwardly at a mouth 3e toward the underside of the suitcase. The mouth 3e is formed by a radially extending c-shaped flange on the peripheral wall of the cavity spaced form the upper wall and formed with an upper lip which is a continuation of the peripheral wall and a lower lip delimiting the mouth 3e. This cavity receives a stirrup 6 and a roller 2. More particularly, the stirrup 6 is a fork between the limbs 6a and 6b of which a roller 2 is journaled on a pin 6c locked at its ends by nuts 6d (FIG. 1). The stirrup has a sleeve 7 which is held onto a pin 8 by a split ring 8a, the head 9 of the pin 8 being lodged in the upper wall of the housing 3 to permit a swiveling of the roller 2 about the axis defined by the pin 8. Because of this swiveling action, the roller 2 can assume different positions within the housing 3.

A cover 4 is carried by the stirrup 6 and may be welded or otherwise anchored thereto at the upper end 11 of this cover which engages the sleeve 7. The cover 4 thus forms part of a shell 15 which can rotate within the cavity 3d although the cover 4 spans the mouth 3e thereof and substantially closes off the interior of the housing 3.

The cover 4 is downwardly convex and has a hemispherical shape. It is provided with an opening 5 through which a horizontal lower segment 2a of the roller 2 projects downwardly. The cover 4 conforms to the shape of the downwardly-turned edge of the cavity so that it is not possible for dirt and contaminants to collect in the cavity 3d . The opening 5 in the cover 4, which surrounds the roller 2, is only sufficiently large that rotation of the roller 2 on its pin 6c will not be limited but is not sufficient to permit access of dirt or foreign bodies into the interior.

Upon a swiveling of the stirrup 6, the cover 4 also can rotate about the axis of the pin 8 because of its connection to the stirrup.

It will be apparent, therefore, that the cover 4 prevents foreign bodies from entering the space around the stirrup 6 and the roller 2 and provides an effective contact of even relatively high obstructions against the stirrup and the roller. Upon movement of the roller 2 in a direction to the left in FIG. 2, a swiveling of the stirrup 6 and the roller 2 will be effected to bring the roller into the FIG. 2 position, the cover 4 being rotated similarly. Any obstructions thus engage the cover 4 before the roller 2 reaches the obstruction.

Figure 4:
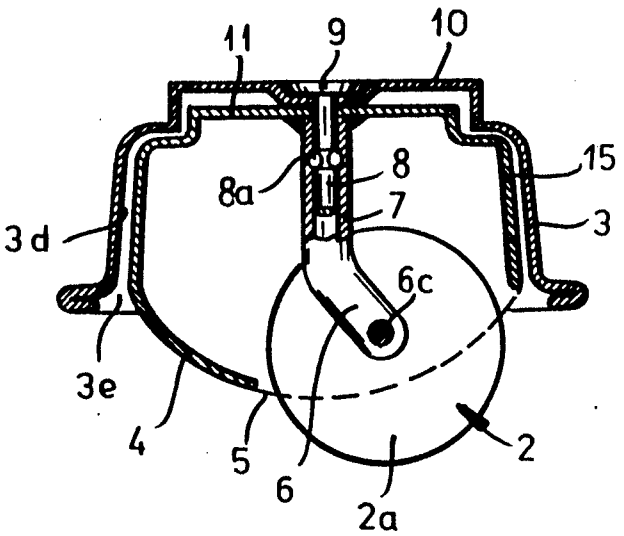
FIG. 4 is a cross sectional view taken along the line IV—IV of FIG. 3.
Figure 6:
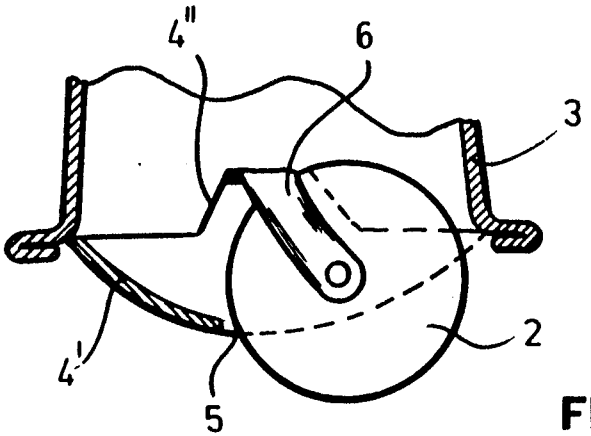
FIG. 6 is a cross sectional view of a portion of a roller assembly in a section similar to that of FIG. 4.

In FIG. 6 I have shown a modification in Which the hemispherical cover 4' terminates at the mouth but has, within the housing 3, formations 4'' (only one of which is visible in FIG. 6) which connect the cover 4' to the stirrup 6. Otherwise the assembly of FIG. 6 operates in the manner described with respect to FIG. 4.

Figure 7:
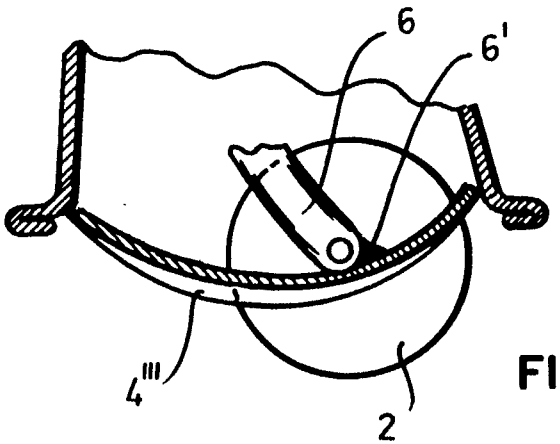
FIG. 7 is a view similar to FIG. 6 but illustrating an embodiment in which the spherical shield closing the mouth of the housing is attached directly to the arms of the fork.

In the embodiment of FIG. 7, the spherical shield or cover 4''' terminates at the mouth and is directly attached, e.g. by welding at 6' to the arms of the fork or stirrup 6. This minimizes the extent to which the shield or cover need penetrate into the mouth.

I claim:

1. A roller assembly for an article of luggage, comprising:

a housing adapted to be received in said article of luggage and having a cavity opening downwardly at a mouth of said housing and an upper wall spaced from said mouth;

a member including a stirrup received in said cavity and a pair of limbs extending downwardly from said upper wall, and a downwardly convex cover spaced from said upper wall and spanning said mouth, said cover being provided with an opening;

mounting means mounting said stirrup swivellably about a swivel axis on said upper wall of said housing; and a roller received in said cavity and journaled in said stirrup between said limbs, said roller projecting downwardly beyond said mouth through said opening and forming a unit with said stirrup, said unit being rotatable about said swivel axis relative to said housing, said cover protecting said stirrup against impact with obstructions and closing said cavity against incursion of foreign matter, said convex cover being secured to the member including said stirrup to swivel therewith.

2. The roller assembly defined in claim 1 wherein said cover is generally spherically curved.

3. The roller assembly defined in claim 2 wherein said cover is generally hemispherical.

4. The roller assembly defined in claim 1, further comprising, said roller being rotatable about a roller axis offset horizontally from said swivel axis.

5. The roller assembly defined in claim 4 wherein said cover is spherically curved.

6. The roller assembly defined in claim 5 wherein said cover has a substantially hemispherical shape.

7. A roller assembly for an article of luggage, comprising:

a housing adapted to be received in said article of luggage and having a cavity opening downwardly at a mouth of said housing, said housing being formed with:

an upper wall, and a peripheral wall extending downwardly form said upper wall, said peripheral wall being formed with a radially extending C-shape flange spaced from said upper wall and formed with an upper lip being continuation of said peripheral wall and a lower lip delimiting said mouth;

a stirrup received in said cavity and provided with:

a pair of limbs extending downwardly from said upper wall, a downwardly convex cover operatively connected with said limbs and nested within said housing, said cover spanning said mouth and being formed with:

a lower side extending toward said peripheral wall and terminating in said cavity above said lower lip, and an elongated opening through said convex cover, mounting means swivellably mounting said stirrup about a swivel axis on said upper wall of said housing; and a roller received in said cavity and journaled in said stirrup between said limbs, said roller projecting downwardly through said opening beyond said mouth, so that said housing protects said stirrup against impact with obstructions.

* * * * *